US005555911A

United States Patent [19]

Fukano et al.

[11] Patent Number: 5,555,911

[45] Date of Patent: Sep. 17, 1996

[54] DIRECTIONAL CONTROL VALVE AND A VALVE ASSEMBLY USING DIRECTIONAL CONTROL VALVES

[75] Inventors: Yoshihiro Fukano; Shoichi Makado; Takeshi Arakawa, all of Ibaraki-ken, Japan

[73] Assignee: SMC Kabushiki Kaisha, Tokyo, Japan

[21] Appl. No.: 453,955

[22] Filed: May 30, 1995

Related U.S. Application Data

[62] Division of Ser. No. 238,727, May 5, 1994, Pat. No. 5,462,087.

[30] Foreign Application Priority Data

May 7, 1993 [JP] Japan ..... 5-029283 U
May 11, 1993 [JP] Japan ..... 5-132938

[51] Int. Cl.[6] ..... F15B 13/06

[52] U.S. Cl. ..... 137/625.69; 137/625.64; 137/884

[58] Field of Search ..... 137/596.16, 625.64, 137/884, 625.69

[56] References Cited

U.S. PATENT DOCUMENTS

| | | | |
|---|---|---|---|
| 3,215,158 | 11/1965 | Bass et al. | 137/596.16 X |
| 3,504,704 | 4/1970 | Beckett et al. | 137/625.64 |
| 3,550,621 | 12/1970 | Lansky et al. | 137/884 |
| 4,462,427 | 7/1984 | Neff | 137/884 |
| 4,770,210 | 9/1988 | Neff et al. | 137/884 |
| 5,305,788 | 4/1994 | Mayeux | 137/583 |
| 5,333,647 | 8/1994 | Fukano et al. | 137/596.16 X |

OTHER PUBLICATIONS

Machine Design, vol. 56, No. 7, Apr. 1984, p. 44, "Scanning For Ideas".

*Primary Examiner*—Gerald A. Michalsky
*Attorney, Agent, or Firm*—Oblon, Spivak, McClelland, Maier & Neustadt, P.C.

[57] ABSTRACT

A directional control valve and a valve assembly for incorporating a plurality of control valves is disclosed, in which use of a manifold base, subplates and the like is unnecessary and wherein durability is excellent. A supply port (P) for a pressurized fluid, output ports (A, B) and exhaust ports (EA, EB) which open into a valve hole are defined in a main valve body constituting the directional control valve. The main valve body has linking surfaces thereon for linking together a plurality of control valves in a valve assembly. The supply port (P) and the exhaust ports (EA, EB) penetrate in a direction in which the main valve bodies are linked together at positions deviated from an opening position of the valve hole. In addition, the output ports (A, B) open through output passages on one side surface of the main valve body perpendicular to the linking surfaces. Connecting grooves are defined on upper and lower surfaces of the main valve body. A plurality of the main valve bodies thus constituted are disposed in a linking manner between a pair of end plates, and tie rods are inserted into the connecting grooves so as to clamp the main valve bodies between the end plates.

8 Claims, 7 Drawing Sheets

DIRECTIONAL CONTROL VALVE AND A VALVE ASSEMBLY USING DIRECTIONAL CONTROL VALVES

This is a division of application Ser. No. 08/238,727 filed on May 5, 1994, now U.S. Pat. No. 5,462,087.

BACKGROUND OF THE INVENTION

1. Field of the Invention

The present invention relates to a directional control valve and to a valve assembly employing a plurality of individual directional control valves which are connected together in a linked construction whereby a desired number of individual valves can be linked together without using a manifold base, subplates and the like.

2. Description of the Related Art

There have been previously known valve structures in which a plurality of directional control valves are installed on an integrated manifold base having a supply passage and an exhaust passage for a pressurized fluid, or wherein the directional control valves are respectively installed on a subplate having a supply passage and an exhaust passage for a fluid, whereby the valves are capable of mutual communication with each other in a linking manner in order to collectively supply and exhaust a pressurized fluid to the plurality of directional control valves.

However, when a plurality of directional control valves are installed on a manifold base or subplates, as described above, problems arise in that time and labor are required for installation of the directional control valves on the manifold base or subplates, and the manifold or subplates require the directional control valves to occupy a large space and height. Further, difficulties arise in that it becomes necessary to prepare the manifold or subplates taking into account the number of directional control valves which are to be linked together, so that the manifold or subplates correspond to the length of the so-linked directional control valves. As a result, the number of required parts increases, and an inconvenience arises in that production cost for the directional control valves and the valve assembly thereof increases.

In order to solve such problems, there has been proposed a valve assembly in which a plurality of directional control valves are stacked together, and in which supply ports and exhaust ports to be mutually communicated by such a linking construction are connected by bolts and nuts passing through connecting holes which extend through the directional control valves.

Such directional control valves and valve assemblies have advantages in that time and labor for installing the directional control valves are decreased, and the space and height required for installation can be kept small, because neither a manifold nor subplate is used.

Such a known stacking-type directional control valve is shown in FIG. 1. In this directional control valve, a valve hole 2 is defined at a central portion in a longitudinal direction of a main valve body 1, and a valve member 3 is displaceably provided in the valve hole 2. A solenoid 4 is provided at one end side of the main valve body 1, whereby an ON-OFF operation of the solenoid 4 allows the aforementioned valve member 3 to be displaced to the right or left as illustrated in the figure. Output ports A, B are provided on an upper surface of the main valve body 1, and a supply port P and exhaust ports EA, EB are defined perpendicularly to the valve member 3 on a side surface of the main valve body 1. Incidentally, in the figure, reference numerals 5, 6 indicate holes for linking together large number of such directional control valves by inserting bolts.

However occurrence of a different problem occurs in such a directional control valve in that a pressurized fluid which flows through the supply port P and the exhaust ports EA, EB penetrating through the main valve body 1, flows across the valve hole 2, so that the pressurized fluid comes into contact with a lubricant such as grease or the like applied to the valve member 3, and the lubricant is splashed about by the fluid. Thus, the durability of the directional control valve itself deteriorates due to a deficiency in lubrication of the valve member 3. Further, when an individual directional control valve must be exchanged or repaired due to failure or breakage, it is impossible to remove a single directional control valve from the valve assembly unless the valve assembly is completely disassembled, so that maintenance of the valve assembly is troublesome.

SUMMARY OF THE INVENTION

It is an object of the present invention to provide a directional control valve and a valve assembly thereof in which it is unnecessary to use a manifold base, subplates and the like, and wherein the durability of the valves and valve assembly is excellent.

It is another object of the present invention to provide a directional control valve and a valve assembly thereof in which the number of parts is minimized, and wherein the number of individual valves employed in the linked construction of the assembly can be freely adjusted.

It is still another object of the present invention to provide a directional control valve and a valve assembly thereof which can be produced inexpensively.

It is still another object of the present invention to provide a directional control valve and a valve assembly thereof in which maintenance is easy.

According to the present invention, there is provided a directional control valve comprising:

a valve member; and a main valve body including a valve hole for allowing said valve member to be displaceably fitted and inserted therein, a supply port for a pressurized fluid, at least one output port and at least one exhaust port, in which linking surfaces for linking together a plurality of directional control valves are respectively formed on a pair of opposing side surfaces of the main valve body;

wherein the supply port and the at least one exhaust port penetrate from one of the linking surfaces to the other linking surface on the opposing side surface of the main valve body in a direction perpendicular to a longitudinal direction of the valve hole, and a partition wall is disposed on one of the linking surfaces corresponding to a position of the valve member so as to prevent the pressurized fluid from flowing thereinto from the supply port.

It is preferable that the output ports are provided on a side surface of the main valve body which is different from the side surfaces on which the two linking surfaces are provided.

It is further preferable that a connecting groove for linking together the directional control valves is provided on at least an upper surface of the main valve body.

It is further preferable that a connecting groove for linking together the directional control valves is provided on a lower surface of the main valve body.

It is preferable that the supply port and the exhaust ports are defined in parallel underneath the valve hole into which the valve member is fitted and inserted.

It is also preferable that the output ports communicate with passages defined in parallel over the valve hole into which the valve member is fitted and inserted, and open on a side surface other than the linking surfaces of the main valve body.

It is further preferable that the valve member comprises a spool valve.

According to the present invention, there is also provided a valve assembly comprising a plurality of directional control valves substantially identical in shape, a first end plate and a second end plate for respectively joining together the directional control valves at respective ends of the plurality of directional control valves, and at least one clamping member for integrally linking together the plurality of directional control valves and the first and second end plates;

wherein each of the plurality of directional control valves has at least one open connecting groove for allowing the clamping members to be fitted thereinto, and wherein the first and second end plates have at least one fastening means for allowing the clamping members to be fastened thereto.

In the aforementioned valve assembly, each of the directional control valves may comprise:

a valve member; and a main valve body including a valve hole for allowing said valve member to be displaceably fitted and inserted therein, a supply port for a pressurized fluid, at least one output port and at least one exhaust port, in which linking surfaces for linking together a plurality of directional control valves are respectively formed on a pair of opposing side surfaces;

wherein the supply port and the at least one exhaust port penetrate from one of the linking surfaces to the other linking surface on the opposing side surface of the main valve body in a direction perpendicular to a longitudinal direction of the valve hole, and a partition wall is disposed on one of the linking surfaces corresponding to a position of the valve member so as to prevent the pressurized fluid from flowing thereinto from said supply port.

It is preferable that the valve body of each of the directional control valves includes an engaging groove which opens on a lower surface and penetrates in a direction in which the directional control valves are linked together, and includes an engaging spring which protrudes into the engaging groove, wherein a space defined by the engaging spring and the engaging groove is used to resiliently hold a connecting pin member.

It is further preferable that the clamping members are tie rods, wherein tips of the tie rods are screwed into holes defined in the first and second end plates, so as to link and hold together the plurality of directional control valves.

It is further preferable that each of the directional control valves has open connecting grooves for receiving therein the tie rods on upper and lower surfaces of the main valve body, and that the tie rods are fitted and inserted into each of the upper and lower connecting grooves.

It is also preferable that the connecting grooves defined on the main valve body are deviated from each other along an extending direction of the valve hole.

It is further preferable that a gasket is arranged on one linking surface of the main valve body which constitutes each of the directional control valves.

It is further preferable that the output ports of the directional control valve are provided on a side surface of the main valve body which is different from the side surfaces on which the two linking surfaces are provided.

BRIEF DESCRIPTION OF THE DRAWINGS

Other objects and advantages of the present invention will become more apparent from a preferred embodiment of the present invention which shall be explained in detail hereinafter with reference to attached drawings, wherein.

DESCRIPTION OF THE PREFERRED EMBODIMENT

Figure 1:
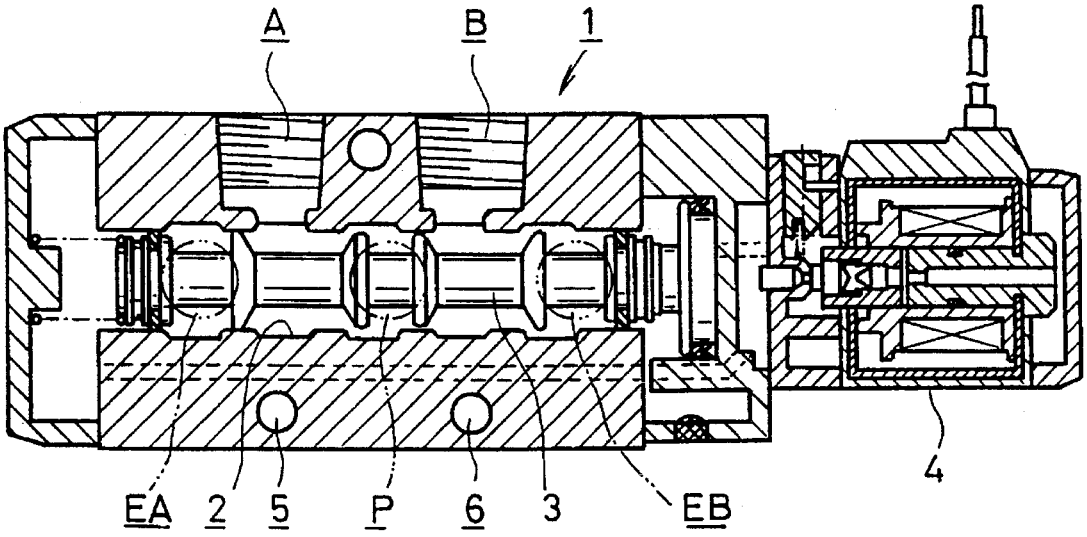
FIG.1 PRIOR ART
FIG. 1 is a vertical cross-sectional view of a known stacked-type directional control valve.
Figure 2:
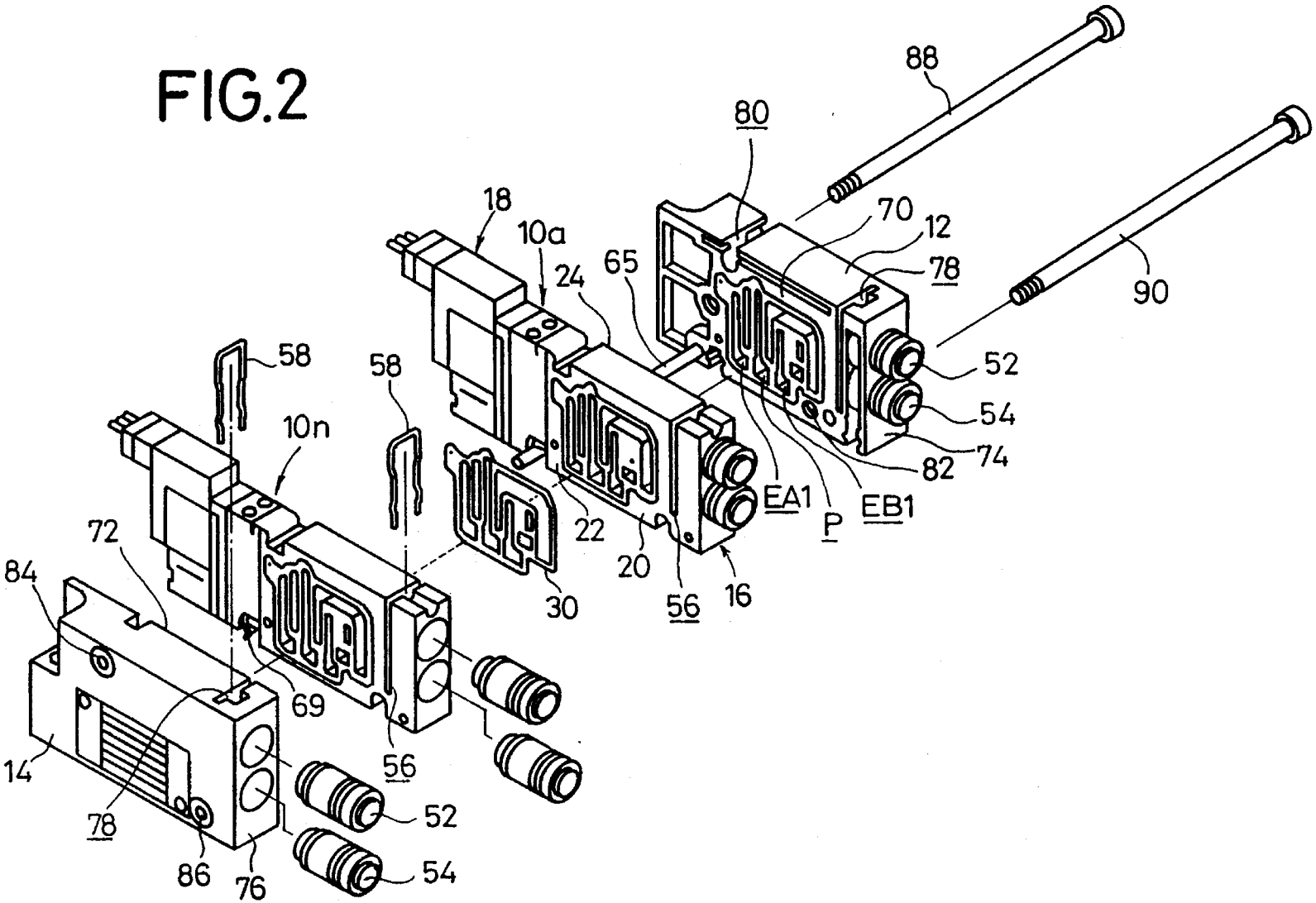
FIG. 2 is an exploded perspective view of one embodiment of a valve assembly in which directional control valves according to the present invention are incorporated.
Figure 3:
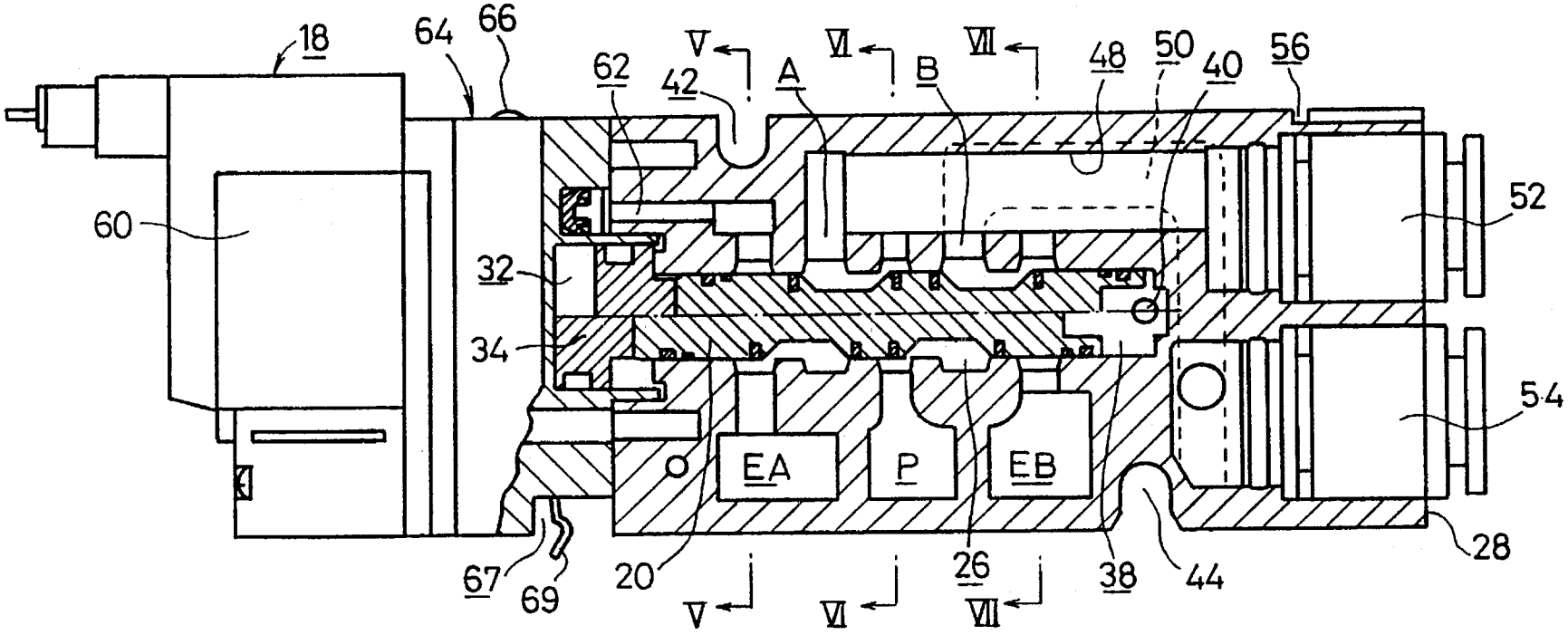
FIG. 3 is a cross-sectional view of a principal part of the directional control valve shown in FIG. 2.
Figure 4:
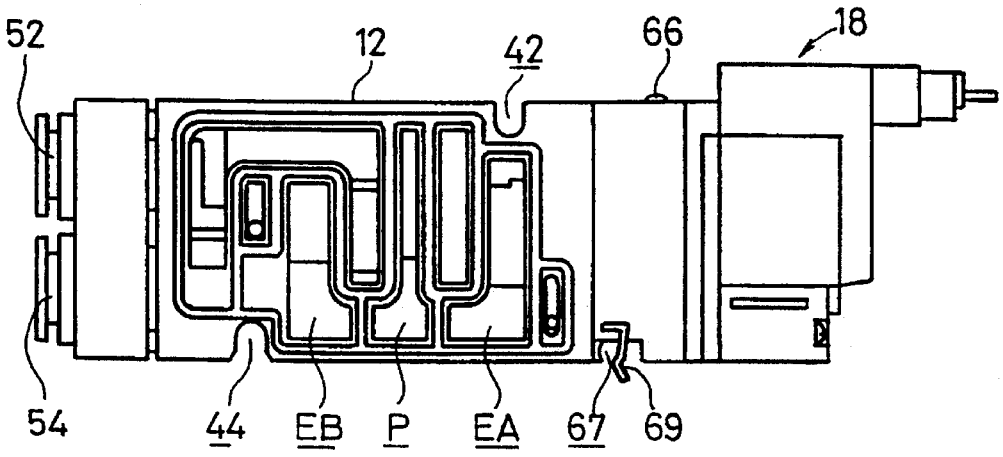
FIG. 4 is a back view of the directional control valve shown in FIG. 2.

FIG. 2 through 12 show an embodiment of the present invention. This embodiment includes a predetermined number of directional control valves 10*a* through 10*n* which are operatively linked together as shown, and further including a pair of end plates 12 and 14. The end plate 12 is linked to the directional control valve 10*a* at one end of the assembly, while the end plate 14 is linked to the directional control valve 10*n* at the other end of the assembly. The directional control valves 10*a* through 10*n* and the end plates 12, 14 are integrally connected by means of tie rods and nuts, as described further hereinbelow. Each of the aforementioned directional control valves 10*a* through 10*n* is constituted as a pilot-type valve having a main valve 16 and a pilot valve 18, however, the directional control valves 10*a* through 1O*n* of the present invention are not limited thereto. It is a matter of course that control valves in which a flow of pressurized fluid between ports is changed by another operation force such as provided by a solenoid, a mechanical operation force, or the like, may also be used as control valves in accordance with the present invention.

A main valve body 20 of the aforementioned main valve 16 has an approximate rectangular parallelepiped shape, and comprises a pair of linking surfaces 22, 24 on opposing front and back surfaces thereof. Spaces for defining a supply port P for the pressurized fluid, output ports A, B and exhaust ports EA, EB are defined with respect to the linking surface 22, and the supply port P and the exhaust ports EA, EB open through to the opposing side surface comprising the aforementioned linking surface 24. Therefore, when a plurality of main valves 16 are provided in a linking manner, so as to allow the linking surface 22 of one of the aforementioned main valve bodies 20 to abut against a linking surface 24 of an adjoining main valve body 20, then the supply ports P and the exhaust ports EA, EB consequently communicate with each other, respectively. Further, the supply port P, the output ports A, B and the exhaust ports EA, EB individually communicate through narrow width passages with a valve hole 26 defined in a direction approximately perpendicular to the direction in which the main valve bodies 20 are linked together. On the other hand, the output ports A and B individually open through output flow passages, described in further detail below, to another side surface 28 of the main valve body 20 having a narrow width and which is disposed approximately perpendicular to the linking surfaces 22, 24. In addition, a gasket 30 is attached to the linking surface 24 in order to shield the area surrounding the aforementioned supply port P, the output ports A, B and the exhaust ports EA, EB in an air-tight manner (see FIG. 2).

A piston chamber 32, which has a diameter larger than that of the valve hole 26, is defined at one end of the valve hole 26 in the aforementioned main valve body 20. A valve member 34 is slidably inserted into the valve hole 26, the valve member 34 comprising a spool valve which slides in accordance with comparative magnitudes between an operation force of a pilot fluid pressure acting on the piston chamber 32 and an operation force of a fluid pressure supplied from a back chamber port 40 to a back chamber 38 at a side opposite to the aforementioned piston chamber 32. That is, the valve member 34 slides owing to a difference in area between pressure-receiving surfaces at both ends of the valve member 34 so as to cause the communication between the output ports A and B for the supply port P and the exhaust ports EA and EB to be changed. Incidentally, the aforementioned main valve body 20 has approximately U-shaped connecting grooves 42, 44 formed on upper and lower surfaces thereof (see FIG. 3). Tie rods are inserted into these connecting grooves 42, 44 along with nuts, as described below, to make it possible to interconnect a desired number of the main valve bodies 20 in a linked manner. However, the connecting means for the main valve bodies 20 is not limited to such tie rods and nuts, and it is also possible to use other suitable connecting means such as, for example, a steel band and the like.

Figure 5:
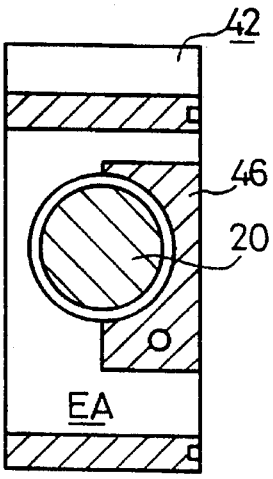
FIG. 5 is a cross-sectional view taken along a line V—V in FIG. 3.
Figure 6:
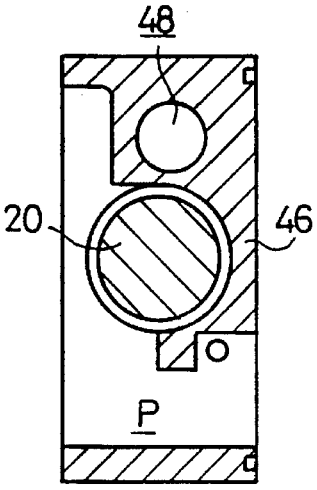
FIG. 6 is a cross-sectional view taken along a line VI—VI in FIG. 3.
Figure 7:
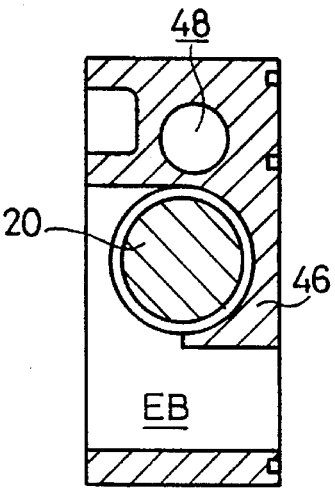
FIG. 7 is a cross-sectional view taken along a line VII—VII in FIG. 3.
Figure 8:
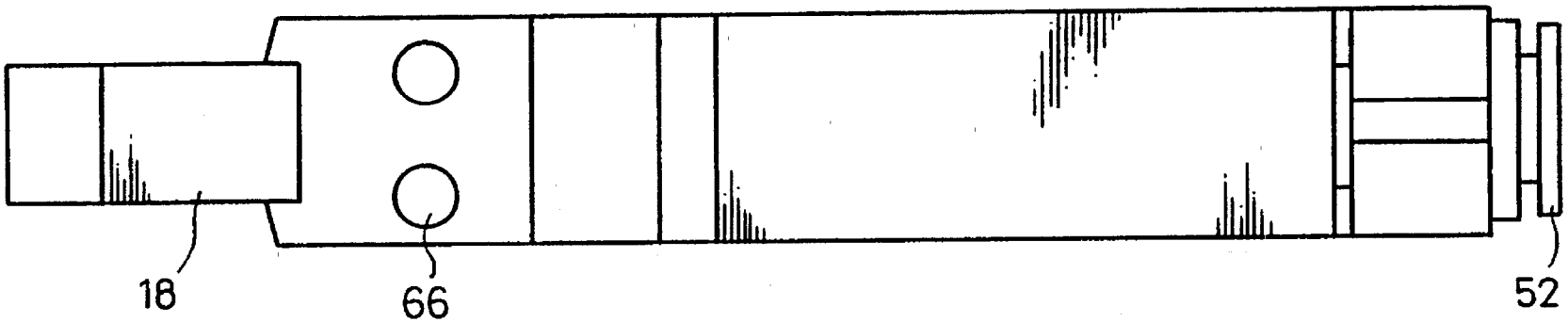
FIG. 8 is a plan view of the directional control valve shown in FIG. 3.
Figure 9:
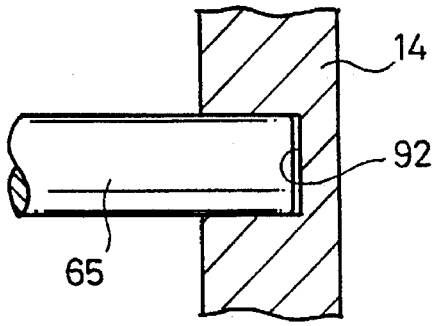
FIG. 9 is a vertical cross-sectional view of a state in which a connecting pin is inserted into an end plate.
Figure 10:
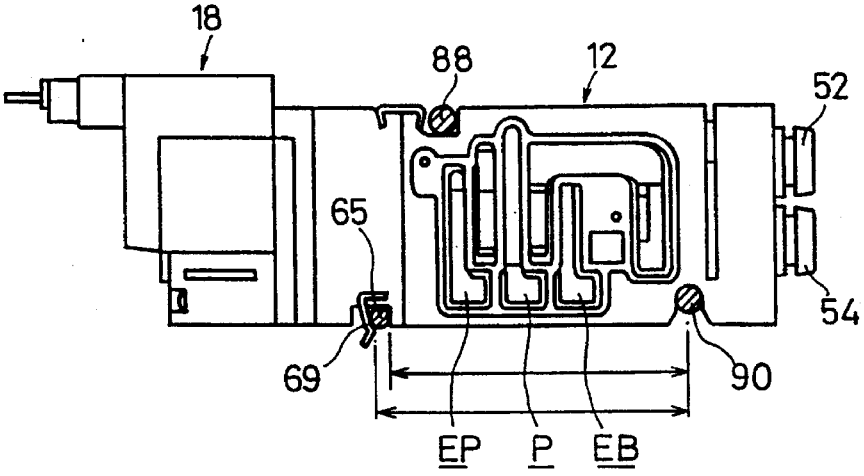
FIG. 10 is a side view representing one linking surface of the directional control valve.

By the way, in relation to the aforementioned supply port P and exhaust ports EA, EB, a partition wall 46 is formed integrally with the main valve body 20, and is disposed approximately parallel to a longitudinal direction of the valve hole 26, whereby a portion of the wall 46 forms a linking surface of the main valve body 20 (see FIG. 5 through 7). In addition, the back chamber port 40 penetrates in a direction in which the main valve bodies 20 are linked together, and a pressurized fluid is supplied to the back chamber port 40 through a passage (not shown).

On the other hand, the output ports A and B open through output passages 48, 50 to the aforementioned side surface 28 of the main valve body 20 (i.e. on a side opposite from the pilot valve 18), and so-called one-touch tube fittings 52, 54 are attached to opening portions of the output passages 48, 50 on the side surface 28 of the main valve body 20. The one-touch tube fittings 52, 54 are detachably attached by means of an approximately U-shaped attachment clip 58 inserted into an attachment groove 56 provided in the main valve body 20.

The aforementioned pilot valve 18 includes a pilot supply port, a pilot output port and a pilot exhaust port (not shown), which is constituted as a well known three-port electromagnetic valve in which magnetic excitation of a solenoid 60 causes the communication between the pilot output port for the pilot supply port and the pilot exhaust port to be changed. The pilot supply port communicates with a pressurized fluid source through the supply port P of the main valve 16, the pilot output port communicates with the piston chamber 32 through a pilot passage 62, and the pilot exhaust port communicates with the exterior atmosphere, respectively.

A manual operating portion 64, which is provided for supplying a pilot fluid pressure to the piston chamber 32 during accidents such as a power failure and the like, is attached between the aforementioned main valve 16 and the pilot valve 18. When a manual operating button 66 provided in the manual operating portion 64 is depressed, a pilot fluid can be manually supplied to the piston chamber 32.

Incidentally, the aforementioned embodiment may employ a five-port valve, however, the directional control valve of the present invention is not limited to a five-port valve, and a three-port or four-port valve may be employed instead.

The end plates 12 and 14 have ports P1, EA1, EB1 which individually communicate with penetrating portions of the aforementioned supply ports P and exhaust ports EA, EB via abutting surfaces 70 and 72 which abut against the main valve bodies 20. The ports P1, EA1, EB1 individually open to the frontal surfaces 74, 76 of the end plates 12 and 14, and one-touch tube fittings 52, 54 are detachably attached to these openings by means of the aforementioned attachment clips 58 which are inserted into attachment grooves 78.

Therefore, a compressed fluid, for example, compressed air can be collectively supplied and exhausted from the one-touch tube fittings 52, 54 to the directional control valves 10*a* through 10*n* connected together in a linked fashion.

The end plate 12 has an upper surface with a connecting groove 80 which is approximately identical in shape to the aforementioned connecting grooves 42, and communicates with the connecting grooves 42 in a linked fashion. The end plate 12 also includes a penetrating hole 82 at a lower position corresponding to the connecting grooves 44. With respect to the end plate 14, nuts 84, 86 are attached in a manner so as to be incapable of rotation at positions corresponding to the connecting grooves 42, 44. Tie rods 88 and 90 are respectively inserted into the aforementioned connecting grooves 80, 42, and through the penetrating hole 82 and the connecting grooves 44, and are screwed respectively into the nuts 84, 86. Further, ends of a connecting pin 65 are inserted into holes 92 formed in each of the end plates 12, 14 (see FIG. 9).

The aforementioned pilot valve 18 is constituted such that magnetic excitation of the solenoid 60 causes a pilot fluid to be supplied and exhausted with respect to the main valve 16. The valve body of the main valve causes communication between the supply port P and the output port A, and between the output port B and the exhaust port EB, when the pilot fluid is supplied. On the other hand, the valve body causes communication between the supply port P and the output port B, and between the output port A and the exhaust port EA, when the pilot fluid is exhausted.

Figure 11:
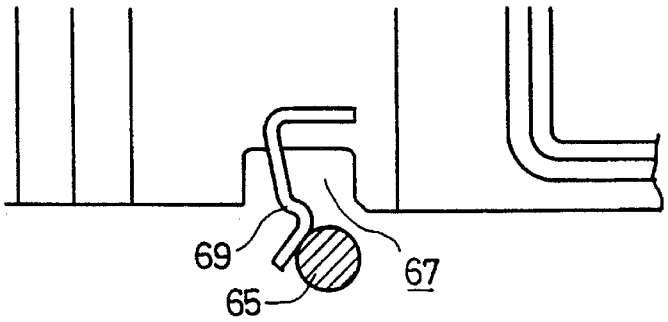
FIG. 11 is an enlarged partial side view of a state in which an engaging spring is engaged with the connecting pin.

One end of the connecting pin 65 is inserted into the hole 92 of the endplate 14, and a desired number of the directional control valves 10*a* through 10*n* are linked together along linking surfaces 22, 24 thereof. The linking surfaces 22, 24 abut against each other while resiliently engaging with the connecting pin 65 via connecting springs 69 having a bent shape and which protrude from engaging grooves 67 provided on lower surfaces thereof, as shown in FIG. 11. On the other hand, when the linking surface 70 of the end plate 12 abuts against the linking surface 24 of the directional control valves 10*a* through 10*n*, and the other end of the connecting pin 65 is inserted into the hole 92 of the end plate 12, then the directional control valves 10*a* through 10*n* and the end plates 12 and 14 are linked together.

Next, the tie rods 88 and 90 are inserted into the upper connecting grooves 80 and 42 and through the penetrating hole 82 and the lower connecting grooves 44, and the tie roads are screwed into the nuts 84, 86 in the end plate 14. Accordingly, a valve assembly in which a desired number of the directional control valves are provided in a linking manner is assembled.

In this case, it will be easily understood that the connecting pin 65 and the tie rods 88, 90 should have lengths corresponding to the desired number of the directional control valves which are to be linked together.

Figure 12:
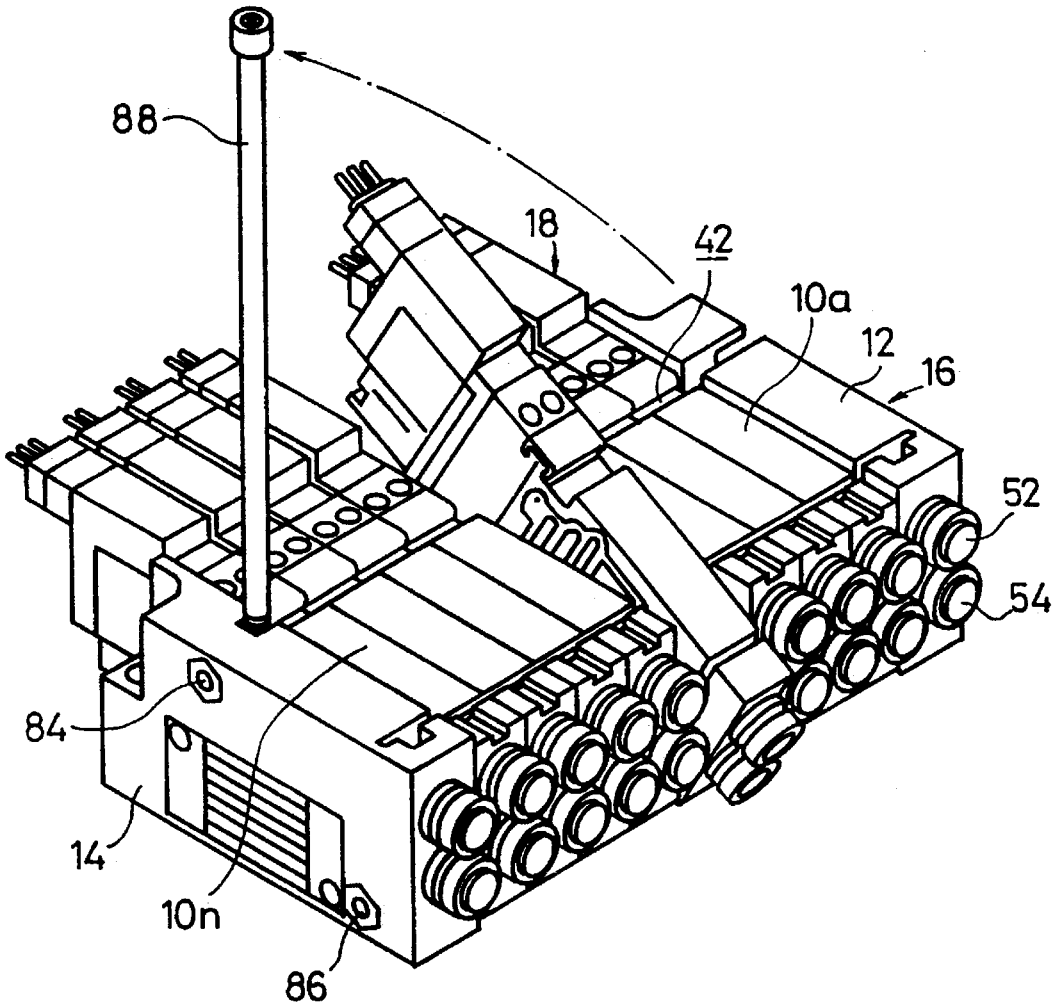
FIG. 12 is a perspective view in which directional control valves are provided in a linked manner, and wherein one directional control valve in the valve assembly is extracted.

When it becomes necessary to exchange or repair one of the directional control valves 10*a* through 1O*n* due to breakage, failure and the like, the screwing attachment of the tie rod 90 to the nut 86 is loosened slightly. Then, the tie rod 88 is unscrewed from the nut 84 and released, and the tie rod 88 is disengaged from the connecting grooves 42 as shown in FIG. 12. It then becomes possible to remove only the one directional control valve subjected to breakage or failure from among the directional control valves 10a through 10*n* of the valve assembly, without requiring disassembly of the remaining valve assembly.

In this case, the other directional control valves do not move owing to the resilient engagement between the engaging springs 69 and the connecting pin 65, so that positions of these directional control valves are not deviated. Therefore, the directional control valve subjected to exchange or repair can be easily reattached in its original position.

In addition, the tie rod 88 can be extracted upwardly from the valve assembly through the openings of the connecting grooves 42, so that a desired directional control valve can be detached from the valve assembly even when there is little or no space in the direction in which the directional control valves are linked together.

Further, it is unnecessary for the main valve body 20 to have a through hole which penetrates therethrough. Therefore, the output ports A and B are allowed to open to one side surface 28 of the main valve body 20, whereby pipings can be easily connected to the output ports through the frontal surface of the valve assembly.

In the valve assembly of the present invention, an individual directional control valve can easily be detached from the valve assembly simply by unscrewing the attachment between the upper tie rod and the nut and extracting the tie rod upwardly from the openings of the upper connecting grooves. Thus, disassembly of the entire valve assembly is not required, and hence maintenance of the valve assembly is easy.

More specifically, when a directional control valve is required to be exchanged or repaired, the nut is simply unscrewed from the tie rod inserted into the upper connecting grooves. Then, the tie rod can be extracted from the connecting grooves through the openings of the connecting grooves, so that only the one directional control valve which is to be exchanged or repaired can be removed from the valve assembly, without totally disassembling the connected valve assembly.

On the other hand, when the exchanged or repaired directional control valve is reinserted into its original position in the valve assembly, the lower connecting groove of the directional control valve is fitted into the lower tie rod, and the upper tie rod is inserted into the connecting grooves through the openings thereof and screwed into the nut. Therefore, the exchanged or repaired directional control valve can be easily reassembled to the valve assembly.

Therefore, upon exchange or repair of a directional control valve, it is unnecessary to disassemble and re-assemble the entire valve assembly, so that maintenance is convenient.

Further, since the upper tie rod can be inserted and detached from an upper position through the openings of the connecting grooves, even if there is little room or space in the direction in which the valve assembly is linked together, exchange or repair of an individual directional control valve can be easily performed.

In addition, because engaging springs are provided on the directional control valves which resiliently engage with the connecting pin between the end plates and hold the end plates in position, the other directional control valves and the end plates thereof do not move even when one of the directional control valves is removed from the valve assembly to be exchanged or repaired.

Further, because a through hole is not required for connection of the directional control valve according to the present invention, the additional space provided by the absence of such a through hole is effectively utilized to allow the output ports to open on a frontal surface of the directional control valve, so that connection of pipings to the output ports is made easy.

In addition, a connecting pin is provided between a pair of end plates, wherein each of the directional control valves is provided with engaging grooves through which the connecting pin passes and in which engaging springs are provided for resiliently engaging with the connecting pin. Accordingly, other directional control valves do not move in position even if an individual directional control valve is removed, and hence complete dismantling of the valve assembly is not required.

Further, the output ports are allowed to open on the frontal surface of the main valve body, so that connection of pipings to the output ports is made easy.

What is claimed is:

1. A directional control valve comprising:

a valve member; and a main valve body including a valve hole extending in a longitudinal direction, said valve hole having said valve member displaceably fitted and inserted therein, a supply port for supplying a pressurized fluid, at least one output port and at least one exhaust port, said main Valve body comprising linking surfaces for linking together a plurality of directional control valves, wherein said linking surfaces are respectively formed on a pair of opposing side surfaces of said main valve body;

wherein said supply port and said at least one exhaust port penetrate from one of said linking surfaces to the other of said linking surfaces on an opposite side surface of the main valve body in a perpendicular direction to said longitudinal direction of said valve hole, said main valve body further comprising a partition wall disposed on one of said linking surfaces, said partition wall being disposed parallel to said valve member extending in said longitudinal direction at substantially a same height as said valve member, so as to prevent the pressurized fluid flowing through said supply port from flowing in said perpendicular direction on one side of said valve member, while permitting said pressurized fluid to flow in said perpendicular direction on another side of said valve member.

2. The directional control valve according to claim 1, wherein the at least one output port is provided on a side surface of the main valve body which is different from the side surfaces on which said two linking surfaces are provided.

3. The directional control valve according to claim 1, wherein a connecting groove for linkage of the directional control valves is provided on at least an upper surface of the main valve body.

4. The directional control valve according to claim 3, wherein a connecting groove for linkage of the directional control valves is provided on a lower surface of the main valve body.

5. The directional control valve according to claim 1, wherein said supply port and said at least one exhaust port are defined in parallel underneath the valve hole into which said valve member is fitted and inserted.

6. The directional control valve according to claim 5, wherein said partition wall prevents said pressurized fluid from flowing in said perpendicular direction on an upper side of said valve member, while permitting said pressurized fluid to flow in said perpendicular direction on a lower side of said valve member underneath said valve hole.

7. The directional control valve according to claim 1, wherein said at least one output port communicates with passages defined in parallel above the valve hole into which said valve member is fitted and inserted, and open on a side surface other than the linking surfaces of said main valve body.

8. The directional control valve according to claim 1, wherein said valve member comprises a spool valve.

* * * * *